US007237794B2

(12) United States Patent
Elkington et al.

(10) Patent No.: US 7,237,794 B2
(45) Date of Patent: Jul. 3, 2007

(54) SNOWBOARD BINDING

(75) Inventors: Mark Elkington, Tuen Mun (HK); Ralph Kohler, Oberperfuss (AT)

(73) Assignee: Goodwell International Ltd., Tortola (VG)

( * ) Notice: Subject to any disclaimer, the term of this patent is extended or adjusted under 35 U.S.C. 154(b) by 295 days.

(21) Appl. No.: 10/810,537

(22) Filed: Mar. 26, 2004

(65) Prior Publication Data

US 2004/0227327 A1 Nov. 18, 2004

(30) Foreign Application Priority Data

Mar. 28, 2003 (DE) ..... 103 14 741

(51) Int. Cl.
*A63C 9/00* (2006.01)

(52) U.S. Cl. ..... 280/619; 280/11.36; 280/624

(58) Field of Classification Search ..... 280/623–637, 280/600, 617, 11.3, 11.36, 809, 811, 619
See application file for complete search history.

(56) References Cited

U.S. PATENT DOCUMENTS 1,542,848 A * 6/1925 Barnes ..... 36/50.1
3,060,600 A * 10/1962 Howe ..... 36/125
3,765,694 A * 10/1973 Allsop ..... 280/637
4,660,303 A * 4/1987 Courvoisier et al. ..... 361/117.9
5,556,123 A 9/1996 Fournier
5,918,897 A 7/1999 Hansen et al.
6,416,074 B1 * 7/2002 Maravetz et al. ..... 280/624
6,938,913 B2 * 9/2005 Elkington ..... 280/607

FOREIGN PATENT DOCUMENTS

DE 44 35 113 C1 5/1996
DE 202 15 907 U1 1/2003
EP 0 705 625 B1 9/1995
JP 8-206275 8/1996

* cited by examiner

*Primary Examiner*—Christopher P. Ellis
*Assistant Examiner*—Vaughn T. Coolman
(74) *Attorney, Agent, or Firm*—Senninger Powers

(57) ABSTRACT

A snowboard binding having a base element that can be fastened to the top of a snowboard. At least one instep element extends over part of a snowboard boot fastened to the base element. The instep element is movable along at least one arc-like path to improve mobility of the boot in the binding.

13 Claims, 3 Drawing Sheets

SNOWBOARD BINDING

FIELD OF THE INVENTION

The invention relates to a snowboard binding.

BACKGROUND OF THE INVENTION

A type of binding has a base element to be fastened to the surface of the snowboard, an instep element fastened to it that partially overlaps the top of a snowboard boot, and a heel element that supports the backside of the snowboard boot and is hinged to pivot on the base element. This type of binding is known from DE 44 35 113 C1 (U.S. Pat. No. 5,918,897; EP 0 705 265 B1, JP 8-206275 A1). The instep element is a large-surface element, in that it covers the snowboard boot in its toe region and in its instep region. The instep element is fastened to the base element via straps that are adjustable in length, namely, a toe strap and an instep strap. In the closed position of the binding, the boot is therefore held between the base element, the instep element and the heel element. Adjustment of the binding to boots of different size is done by length adjustment of the strap securing the instep element and also via the adjustable position of the pivotable heel element, which is done by means of a length-adjustable strap fastened in the front region of the base element and enclosing the heel element on the rear.

A similar snowboard binding is also known from U.S. Pat. No. 5,556,123 A1, wherein fastening of the heel element is configured differently.

The aforementioned bindings are also generally referred to as a soft binding, because they are used together with relatively soft, flexible boots (so-called softboots) that offer the snowboarder relatively high flexibility of movement, both forward and to the side. The flexibility, i.e., the possible range of motion, can be adjusted by adjusting the instep and heel element, so that the snowboarder has, as desired, a large or small latitude of motion of the boot in the binding.

However, when the shinbone is bent laterally along with the shaft of the boot, a problem arises in that the instep element, which lies relatively firmly against the outer top of the boot in the region of the toes and instep, limits this lateral bending movement, especially when the instep element, as in the aforementioned prior art, is designed as a large-surface element and extensively covers the front region of the foot and the instep region of the boot and is adapted to its contour. Even if the instep element is made from a flexible material, lateral movement of the boot is severely hampered in this configuration, which is viewed as a shortcoming, since high flexibility of movement forward and to the side is desirable in precisely this type of binding.

SUMMARY OF THE INVENTION

The problem of the invention is therefore to improve the snowboard binding of the type just mentioned by creating increased flexibility for movements of the boot in the binding, especially for lateral bending or rolling of the boot in the binding.

Briefly, therefore, the invention is directed to a snowboard binding comprising a base element configured for attachment to a top of a snowboard, and an instep element configured to extend over part of a snowboard boot applied to the base element, wherein the instep element is movable along at least one arc-like path.

Advantageous embodiments and modifications of the invention are apparent from the dependent claims.

The basic principle of the invention is that the instep element is movable along at least one arc-like path, and therefore follows the lateral bending or rolling movement of the boot.

The arc-like path is formed by at least one strap, preferably by two straps, namely, a toe strap and an instep strap, which overlap and secure the instep element on the outside. Cooperating guides that limit the arc-like path are provided on this strap and the instep element.

In a specific embodiment, the guides consist of guide openings in the form of slots in the straps and a guide pin on the instep element, the guide pin being passed through the guide openings of the strap and guided against its side walls.

During a lateral rolling movement, the straps therefore remain in essentially an unaltered position, whereas the instep element is movable relative to the straps and can therefore execute, in the broader sense, a pivot movement around a pivot axis lying in the region of the sole of the foot or beneath it.

According to an advantageous refinement of the invention, dampers are provided on the ends of the guide openings that damp movement close to the corresponding limit position. These dampers are preferably constrictions of the guide path, whose width is smaller than the diameter of the pin or inserts made of an elastic material. For secured guiding, the pins have a thickened head on their free end that overlaps the guide openings, so that a secure connection is always present between the instep element and the strap.

According to an advantageous refinement of the invention, the relative mobility between the instep element and the strap can also be blocked. For this purpose, a toothing is provided between the head of the corresponding pin and the outside of the strap opposite it. By rotating the pin by 90°, the toothings can be aligned parallel to each other and therefore engage or be perpendicular to each other, so that the tips of the teeth can slide on one another.

DETAILED DESCRIPTION OF PREFERRED EMBODIMENTS

This application claims priority from German application 103 14 741.1, filed Mar. 28, 2003, the entire disclosure of which is expressly incorporated herein by reference.

The invention is explained in more detail below by means of a practical example in connection with the figures. The same reference numbers in the individual figures denote identical or functionally corresponding parts.

Figure 1:
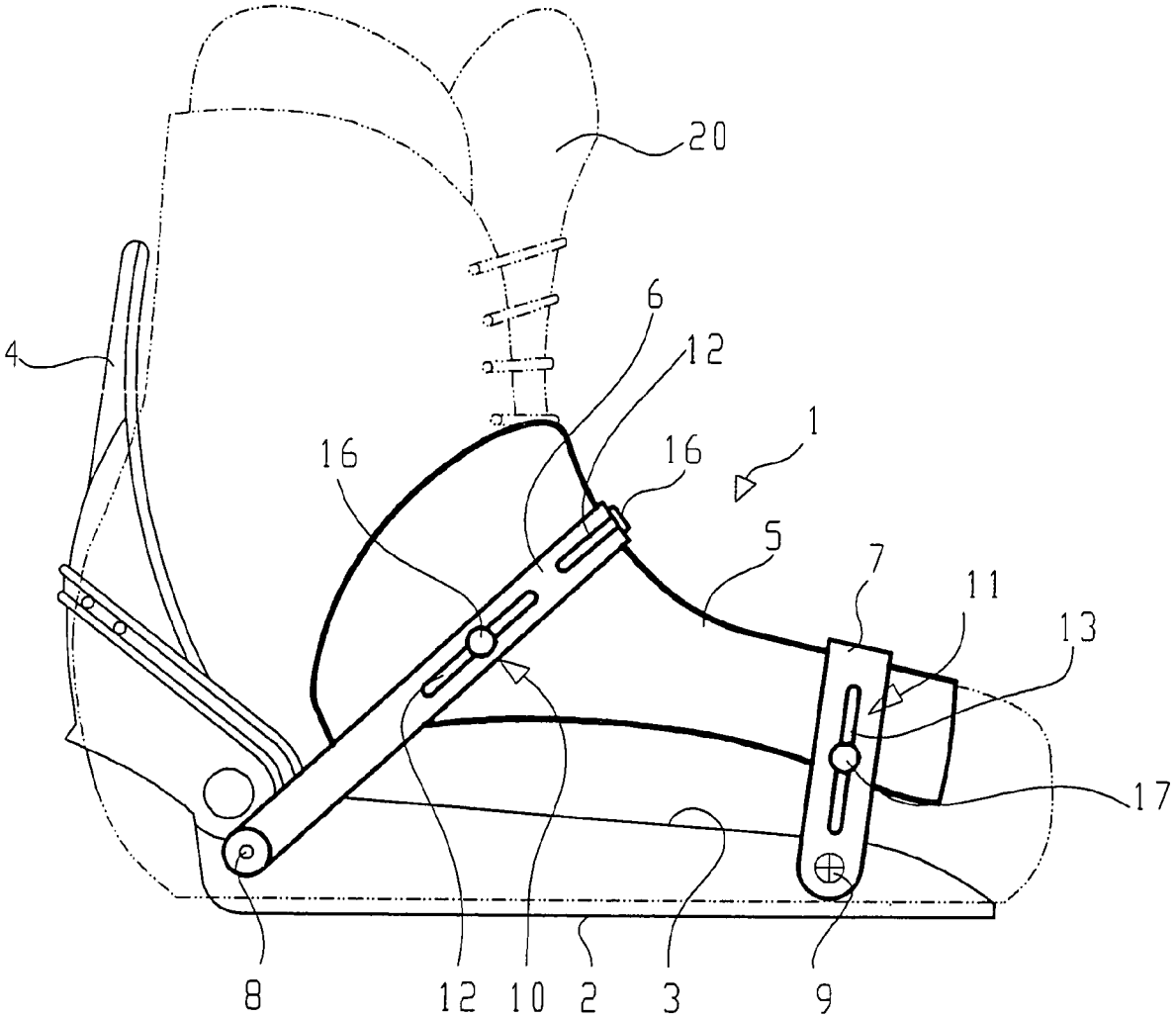
FIG. 1 shows a schematic side view of the snowboard binding according to the invention.

FIG. 1 shows a schematic side view of the snowboard binding 1, which has a base element 2 to be fastened on the surface of a snowboard (not shown) and has a side wall 3 directed essentially vertically upward on its long sides, which is a component of the base element. A heel element 4 (not further described) is arranged to pivot on both side walls in the rear region of the binding and can be pivoted rearward to open the binding and forward to close the binding, in which case it can be fastened in known fashion in the closed position (cf. DE 44 35 113 C1).

The binding also has an instep element 5, constructed here as a large-surface element, and it covers the instep and toe region of a boot 20 and is adaptable to its contour, because of its internal flexibility. The instep element 5 is secured on two arc-like straps, namely, an instep strap 6 and a toe strap 7, whose ends are fastened to the base element 2 and, more precisely, to its side walls 3, and specifically to pivot bearings 8 or 9. The two straps 6 and 7 are made of a flexible material, but have high tensile strength in the longitudinal direction. The straps 6 and 7 overlap the instep element 5 on its outside.

The instep element 5 is movable relative to the arc-like path formed by straps 6 and 7. For this purpose, the instep element is fastened to straps 6 and 7 via guides 10 and 11. These guides, in the practical example depicted here, consist of guide openings 12 or 13 in the form of slots in straps 6 and 7 and of a guide pin 16, 17 fastened to the instep element 5, which passes through the mentioned guide openings 12 or 13 and has a thickened head 16' on its free end that is larger than the width of the guide openings 11 or 12 and therefore extends over them.

The pin 16, 17 is therefore movable along the guide openings 11 or 12, so that the instep element firmly coupled to pin 16, 17 can follow this movement, which is formed by the arc-like path.

For length adjustment of the two straps 6 and 7, conventional toothed belts 21, 22, are provided in combination with fasteners 23 and 24 that are mounted on the straps 6 or 7. The toothed belts 21 or 22 are introduced into this fastener 23 or 24 and secured there by a form fit.

Figure 2:
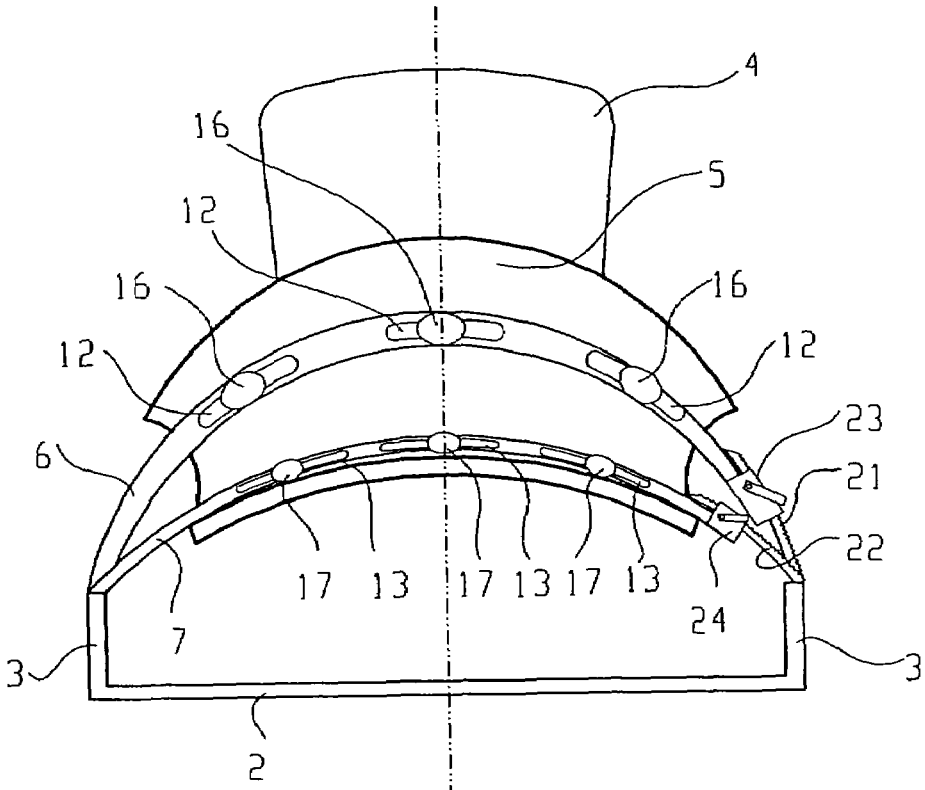
FIG. 2 shows a schematic front view of the snowboard binding in a neutral position.

The instep element 5 in FIG. 2 is shown in a neutral, middle position. The guide pins 16 and 17 lie in the center of the guide openings 12 and 13.

Figure 3:
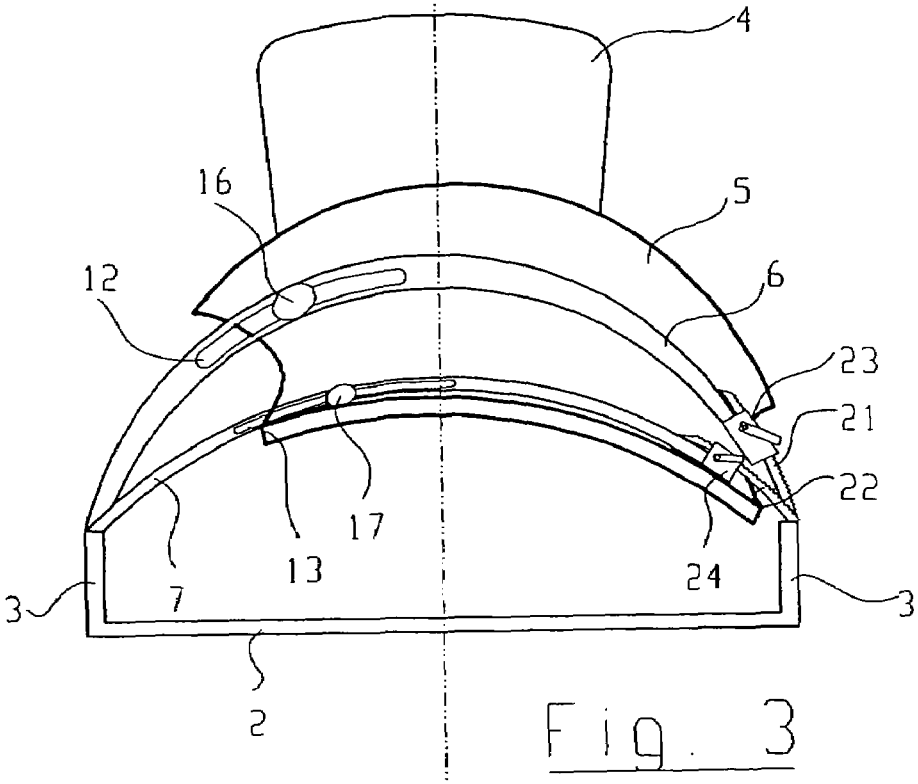
FIG. 3 shows a schematic front view of a snowboard binding in a pivot position.

The instep element 5 in FIG. 3 is shown in a pivot position. The pins 16 and 17 are stopped against one end of the guide openings 12 or 13. It should be pointed out here that the corresponding limit positions can also be asymmetric, i.e., the pivot movement of the instep element in one direction is greater than in the other.

It is also pointed out that displacement of the pins 16 and 17 on the front strap 7 and rear strap 6 can be of different magnitude, since the instep element 5 is itself flexible and can therefore follow deformations of the boot 20, and because the lateral displacement in the instep region can be greater than in the toe region.

Figure 4:
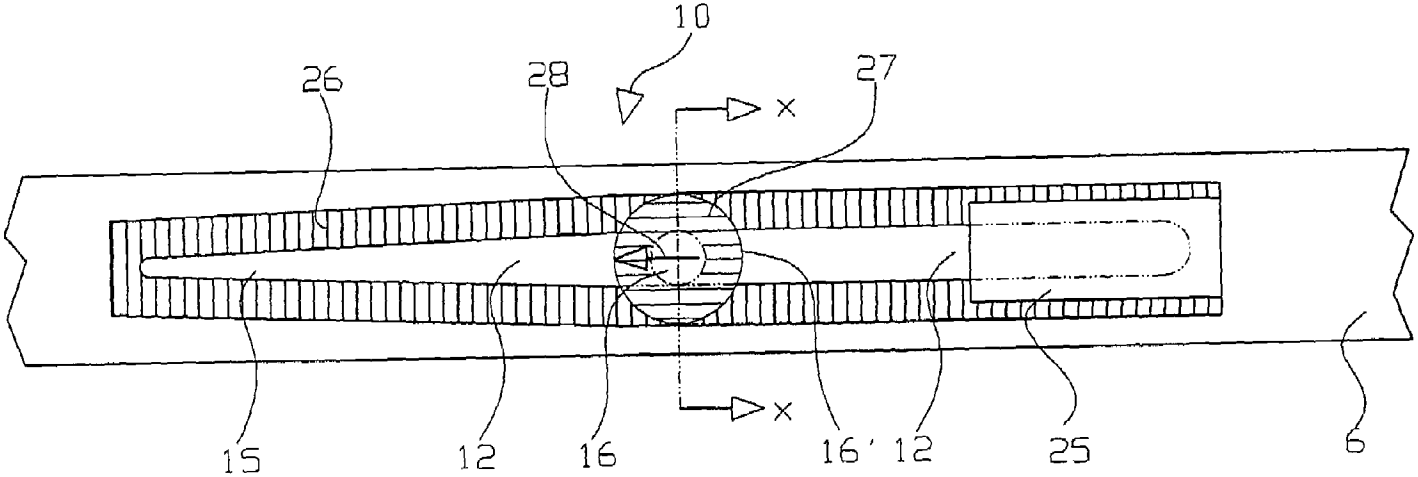
FIG. 4 shows a top view of a guide.

FIG. 4 shows a top view of a cutout of the guide 10 with the guide opening 12 and the guide pin 16 inserted in it. In order to damp the pivot movement and avoid a hard impact against the limit positions, dampers are provided. These dampers in the left part of FIG. 4 consist of a constriction 15 of guide opening 12 that tapers to a point, the width of the constriction diminishing continuously to the end and being smaller than the diameter of pin 16. When pin 16 slides into this constriction 15, the constriction 15 must be widened, which causes mechanical deformation work in the strap 6 under tensile stress, consuming energy and offering resistance to movement of the pin 16 along constriction 15, which increases in the direction toward the end of constriction 15. At the same time, the friction forces between pin 16 and the wall of constriction 15 also increase, which damps the movement.

In the right part of FIG. 4, an insert 25 inserted into the guide opening 12 in the region of its end is provided to damp the movement. The insert 25 consists of a rubber-like material. As soon as the pin 16 has stopped against insert 25, the insert 25 is increasingly deformed and therefore forms an increasing resistance to further displacement of pin 16, so that the damping effect is also achieved. It should be pointed out in this context that the two described dampers, constriction 15 and insert 25, can also be combined, i.e., applied simultaneously in the region of one or both ends of the guide opening 12. It is also possible to apply one or both dampers only on one side of the guide opening. The insert 25 can also be configured to be replaceable, so that the snowboarder can alternately use an insert with different damping characteristics.

The relative mobility between the instep element and the corresponding strap 6 and/or 7 can also be blocked and deactivated. For this purpose, in addition to the guide opening 12, checks are provided. In the embodiment shown, these constitute toothing 26 running across its longitudinal direction and a corresponding counter-toothing 27 on the bottom of the thickened head 16' of pin 16 are provided. The pin, together with head, is then fastened so that it can be rotated by at least 90°. In the position depicted in FIG. 4, the toothings 26 and 27 are aligned at right angles, so that the corresponding teeth cannot mesh, but their tips slide on each other instead, thus ensuring mobility. This can also be alerted to the snowboarder by an arrow 28 on the top of the head. If the pin 16, together with head 16', is rotated by 90°, the toothings lie parallel to each other, so that the teeth can mesh and the mobility is blocked. It is therefore also possible to select and fix a stipulated relative position between instep element 5 and strap 6 or 7.

Figure 5:
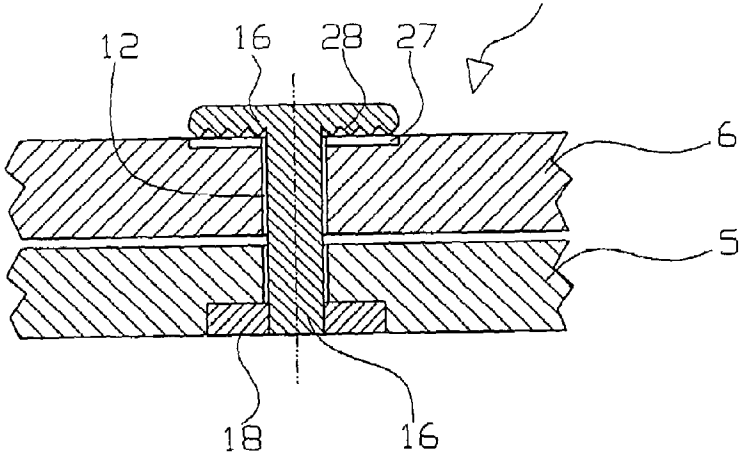
FIG. 5 shows a cross section along line x-x of FIG. 4.

FIG. 5 shows a section along line x—x of FIG. 4. It is particularly apparent here that the pin 16 is fastened against step element 5 by fastener 18. For example, it can be riveted or screwed on. It is also readily apparent that the pin 16 has a widened head 16' that extends over the guide opening 12 of strap 6 and therefore prevents inadvertent loosening of the instep element 5 from strap 6. Here again, the described toothing 26, 27 is readily apparent, the pin 16, together with head 16', being aligned here again, so that sliding is possible.

Finally, it is pointed out that the guides 10 and 11 can also be configured differently; for example, a dovetail guide, a guide with a double-U profile or other guides known in mechanical engineering can be used.

In FIGS. 1 to 3, three guides 10 and 11 each are applied for each set of straps 6 and 7, specifically laterally on both sides and in the middle. It is naturally also possible to apply the guide only on both sides of the instep element 5 or only in the middle of instep element 5 or only on one side or only on one side and in the middle. Other combinations are also conceivable in which only one guide is applied, for example, on the front toe strap 7, whereas two or three guides are present on the rear instep strap 6. It is also pointed out that the instep element 5 can be secured by only a single strap. Finally, it is also possible, if two straps 6 and 7 are used, to divide the instep element 5 into two elements, each of which is then fastened to one of the straps 6 or 7. In this case, it can also be sufficient if only the element fastened to the rear instep strap is movable according to the invention, whereas the front element remains unmovable, since movement in the instep region is more important than in the toe region.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above methods and products without departing from the scope of the invention, it is intended that all matter contained in the above description and shown in the accompanying drawings shall be interpreted as illustrative and not in a limiting sense.

What is claimed is:

1. A snowboard binding comprising:

a base element configured for attachment to a top of a snowboard;

an instep element configured to extend over part of a snowboard boot applied to the base element, wherein the instep element is movable along at least one arc-like path formed by at least one strap that is fastened on both sides to the base element and extends over the instep element;

at least one guide on the at least one strap and the instep element which limit the arc-like path;

wherein each guide is formed by at least one guide opening in the form of a slot in the at least one strap and a guide pin on the instep element, with the guide pin passing through the guide opening and being guided on side walls of the guide opening.

2. The snowboard binding of claim 1 further comprising at least one damper on one or both ends of the guide openings to damp movement of the pin in a longitudinal direction of the guide opening.

3. The snowboard binding of claim 2 wherein the dampers are formed by constrictions of the guide opening whose width is smaller than a diameter of the guide pin.

4. The snowboard binding of claim 2 wherein the at least one damper comprises an insert made of elastic material.

5. The snowboard binding of claim 1 wherein the guide pin has a thickened head on its free end that extends over the guide opening.

6. A snowboard binding comprising:

a base element configured for attachment to a top of a snowboard;

an instep element configured to extend over part of a snowboard boot applied to the base element, wherein the instep element is movable along at least one arc-like path, wherein the arc-like path runs essentially transverse to a longitudinal axis of the binding, and wherein the at least one arc-like path is formed by at least one strap that is fastened on both sides to the base element and extends over the instep element; and at least one guide on the at least one strap and the instep element which limit the arc-like path;

wherein each guide is formed by at least one guide opening in the form of a slot in the at least one strap and a guide pin on the instep element, with the guide pin passing through the guide opening and being guided on side walls of the guide opening.

7. The snowboard binding of claim 2 further comprising at least one damper on one or both ends of the guide openings to damp movement of the pin in a longitudinal direction of the guide opening.

8. The snowboard binding of claim 7 wherein the dampers are formed by constrictions of the guide opening whose width is smaller than a diameter of the guide pin.

9. The snowboard binding of claim 7 wherein the at least one damper comprises an insert made of elastic material.

10. The snowboard binding of claim 6 wherein the guide pin has a thickened head on its free end that extends over the guide opening.

11. A snowboard binding comprising:

a base element configured for attachment to a top of a snowboard;

an instep element configured to extend over part of a snowboard boot applied to the base element, wherein the instep element is movable along at least one arc-like path formed by at least one strap that is fastened on both sides to the base element and extends over the instep element;

at least one guide on the at least one strap and the instep element which limit the arc-like path;

at least two guides on each strap;

checks to block mobility of the instep element along the arc-like path;

wherein:

each guide is formed by at least one guide opening in the form of a slot in each strap and a guide pin on the instep element, with the guide pin passing through the guide opening and being guided on side walls of the guide opening with a thickened guide pin head on its free end that extends over the guide opening;

the checks comprise toothing on a side of the at least one guide opening and counter-toothing on the thickened guide pin head that extends over the at least one guide opening; and the thickened guide pin head being mounted to rotate at least 90°.

12. A snowboard binding comprising:

a base element configured for attachment to a top of a snowboard;

an instep element configured to extend over part of a snowboard boot applied to the base element;

at least one strap fastened on its respective ends to the base element and extending over the instep element to define an arc substantially transverse to a longitudinal axis of the binding; and at least one guide opening and a guide pin received in the at least one guide opening for guiding the instep element along said arc.

13. A snowboard binding comprising:

a base element configured for attachment to a top of a snowboard;

an instep element configured to extend over part of a snowboard boot applied to the base element;

a first strap and a second strap, each fastened on its respective ends to the base element and extending over the instep element to define arcs substantially transverse to a longitudinal axis of the binding; and at least one guide opening and at least one guide pin received in the at least one guide opening for guiding the instep element along said arcs.

* * * * *